US005451296A

United States Patent [19]

Pikulin et al.

[11] Patent Number: 5,451,296

[45] Date of Patent: * Sep. 19, 1995

[54] TWO STAGE PULP BLEACHING REACTOR

[75] Inventors: Michael A. Pikulin, Bound Brook, N.J.; William H. Friend, Savannah, Ga.

[73] Assignee: Union Camp Patent Holding, Inc., Princeton, N.J.

[ * ] Notice: The portion of the term of this patent subsequent to Jan. 26, 2010 has been disclaimed.

[21] Appl. No.: 208,067

[22] Filed: Mar. 8, 1994

Related U.S. Application Data

[60] Continuation of Ser. No. 835,790, Feb. 14, 1992, abandoned, which is a division of Ser. No. 705,691, May 24, 1991, abandoned.

[51] Int. Cl.[6] ..... D21C 7/00; D21C 9/153

[52] U.S. Cl. ..... 162/241; 162/18; 162/65; 162/243; 162/246; 422/225; 422/226; 422/229

[58] Field of Search ..... 162/241, 243, 246, 65, 162/19, 57, 52, 18, 68; 422/224, 225, 226, 229

[56] References Cited

U.S. PATENT DOCUMENTS

| | | | |
|---|---|---|---|
| 1,591,070 | 7/1926 | Wolf . | |
| 1,642,978 | 9/1927 | Thorne . | |
| 1,643,566 | 9/1927 | Thorne . | |
| 1,818,913 | 8/1931 | Van De Carr, Jr. . | |
| 1,957,937 | 5/1934 | Campbell et al. | 8/2 |
| 2,013,115 | 9/1935 | Thorne | 8/2 |
| 2,431,478 | 11/1947 | Hill . | |
| 2,466,633 | 4/1949 | Brabender et al. . | |
| 3,318,657 | 5/1967 | Wade | 8/111 |
| 3,533,563 | 10/1970 | Eriksson | 241/28 |
| 3,630,828 | 12/1971 | Liebergott et al. . | |
| 3,660,225 | 5/1972 | Verreyne et al. | 162/17 |
| 3,663,357 | 5/1972 | Liebergott | 162/65 |
| 3,703,435 | 11/1972 | Schleinofer | 162/17 |
| 3,725,193 | 4/1973 | De Montigny et al. . | |
| 3,785,577 | 1/1974 | Carlsmith | 241/57 |
| 3,814,664 | 6/1974 | Carlsmith | 162/236 |

(List continued on next page.)

FOREIGN PATENT DOCUMENTS

| | | | |
|---|---|---|---|
| 966604 | 4/1975 | Canada . | |
| 970111 | 7/1975 | Canada . | |
| 1103409 | 6/1981 | Canada . | |
| 1119360 | 3/1982 | Canada . | |
| 1132760 | 10/1982 | Canada . | |
| 1112813 | 11/1982 | Canada . | |
| 1154205 | 9/1983 | Canada . | |
| 1181204 | 1/1985 | Canada . | |
| 1186105 | 4/1985 | Canada . | |
| 2012771 | 11/1990 | Canada . | |
| 2028788 | 5/1991 | Canada . | |
| 1310292 | 11/1992 | Canada . | |
| 062539 | 10/1982 | European Pat. Off. . | |
| 106460 | 4/1984 | European Pat. Off. . | |
| 106609 | 4/1984 | European Pat. Off. . | |
| 276608 | 3/1988 | European Pat. Off. . | |
| 308314 | 3/1989 | European Pat. Off. . | |
| 1441787 | 5/1966 | France . | |
| 2609067 | 7/1988 | France | 162/65 |
| WO88/05095 | 7/1988 | WIPO . | |

OTHER PUBLICATIONS

Soteland, "Bleaching of Chemical Pulps With Oxygen and Ozine"; *Pulp & Paper Mag. of Canada,* Apr. 1974, pp. 91–96.

(List continued on next page.)

*Primary Examiner*—Steve Alvo
*Attorney, Agent, or Firm*—Pennie & Edmonds

[57] ABSTRACT

A two stage ozone-pulp bleaching method and apparatus are disclosed. In the first stage, high consistency pulp particles are turbulently mixed and contacted with a gaseous mixture containing ozone to mix and contact substantially all of the pulp particles with ozone to react at least a portion of the pulp particles with the ozone. Pulp particles and gaseous bleaching mixture are then directed to a second stage including a quiescent pulp bed. Pulp particles may complete their reaction in the bed, which also serves to strip ozone which was not contacted with pulp particles in the first stage from the gaseous bleaching mixture.

27 Claims, 10 Drawing Sheets

U.S. PATENT DOCUMENTS

| | | | |
|---|---|---|---|
| 3,832,276 | 8/1974 | Roymoulik et al. | 162/65 |
| 3,964,962 | 6/1976 | Carlsmith | 162/236 |
| 4,046,621 | 9/1977 | Sexton | 162/40 |
| 4,080,249 | 3/1978 | Kempf et al. | 162/57 |
| 4,093,506 | 6/1978 | Richter . | |
| 4,119,486 | 10/1978 | Eckert | 162/65 |
| 4,123,317 | 10/1978 | Fritzvold . | |
| 4,155,806 | 5/1979 | Mannbro | 162/19 |
| 4,158,597 | 6/1979 | Petersson | 162/238 |
| 4,196,043 | 4/1980 | Singh . | |
| 4,216,054 | 8/1980 | Bentvelzen et al. | 162/57 |
| 4,226,673 | 10/1980 | Fremont | 162/29 |
| 4,229,252 | 10/1980 | Meredith | 162/65 |
| 4,274,918 | 6/1981 | Zilka | 162/237 |
| 4,278,496 | 7/1981 | Fritzvold | 162/65 |
| 4,279,694 | 7/1981 | Fritzvold et al. | 162/65 |
| 4,283,251 | 8/1981 | Singh | 162/ |
| 4,295,925 | 10/1981 | Bentvelzen et al. | 162/19 |
| 4,298,426 | 11/1981 | Torregrossa et al. | 162/65 |
| 4,363,697 | 12/1982 | Markham et al. | 162/65 |
| 4,372,812 | 2/1983 | Phillips | 162/40 |
| 4,384,920 | 5/1983 | Markham et al. | 162/19 |
| 4,426,256 | 1/1984 | Johnson . | |
| 4,444,621 | 4/1984 | Lindahl | 162/26 |
| 4,450,044 | 5/1984 | Fritzvold et al. | 162/65 |
| 4,468,286 | 8/1984 | Johnson . | |
| 4,563,243 | 1/1986 | Koch et al. | 162/18 |
| 4,619,733 | 10/1986 | Kooi | 162/30.1 |
| 4,640,782 | 2/1987 | Burleson | 210/748 |
| 4,818,339 | 4/1989 | Lamort | 162/4 |
| 4,913,358 | 4/1990 | Sbaschnigg et al. . | |
| 4,959,124 | 9/1990 | Tsai | 162/65 |
| 5,164,044 | 11/1992 | Griggs et al. | 162/65 |
| 5,174,861 | 12/1992 | White et al. | 162/65 |
| 5,238,501 | 8/1993 | Kappel et al. . | |

OTHER PUBLICATIONS

ASAM Pilot Plant Confirms Laboratory Test Results, by Kraftanlagen Heidelberg, "The Right Approach to Pollution-free Pulping".

Agrawal et al, "Performance of Trough-Paddle Mixing Conveying System for Treatment of Wheat Straw with Small Volumes of Liquids", p. 18.

Allison, R. W., "Effect of Ozone on High-Temperature Thermomechanical Pulp", *Appita,* vol. 32, No. 4 (Jan. 1979) p. 279.

Allison, R. W., "Efficient Ozone and Peroxide Bleaching of Alkaline Pulps From Pinus Radiata," *Appita,* vol. 36, No. 1 (Jul. 1982) p. 42.

Allison, "Production of Bleached Softwood Pulp by Low Pollution Processes", Wood Sci. Technol. 17, pp. 129-137 (1983).

Backlund, A., "A Progress Report on Continuous Digester Development", Paper Presented to the 21st EUCEPA International Conference—Torremolinos, Spain.

Balousek, "The Effects of Ozone Upon Lignin Model Containing the B-aryl Ether Linkage", Svensk Papperstidning, No. 9, 1981.

Carlberg et al., "Bleaching of Sulphite and Sulphate Pulps Using Conventional and Unconventional Sequences", TAPPI Proceedings 1982 Annual Meeting, p. 381.

Casey, J. P., "Bleaching: A Perspective", *TAPPI Journal,* vol. 66, No. 7 (Jul. 1983) p. 95.

Dyck, A. W. J., "New Advances in Mechanical Pulping", *American Paper Industry* (Sep. 1971) p. 21.

Eickeler, "Ozone Measurement with Detector Tubes".

Eriksson and Gierer, "Ozonation of Residual Lignin".

Fujii, et al., "Oxygen Pulping of Hardwoods," TAPPI, Alkaline Pulping/Secondary Fibers Conference (Washington, D.C., Nov. 7-10, 1977).

Gangolli, "The Use of Ozone and Pulp in the Paper Industry".

Germgard and Sjorgren, "Ozone Prebleaching of a Modified-Cooked and Oxygen-Bleached Softwood Kraft Pulp", Svensk Papperstidning, No. 15, (1985).

Germgard et al., "Mathematical Models for Simulation and Control of Bleaching Stages", Nordic Pulp and Paper Research Journal, No. 1 (1987).

Gierer, "Chemistry of Delignification, Part 2: Reactions of Lignins During Bleaching", Word Science and Technology (1986).

Godsay and Pearce, "Physico-Chemical Properties of Ozone Oxidized Kraft Pulps", Oxygen Delignification (1984).

Grant, R. S., "Displacement Heating Trials With a New Process to Reduce Steam", *TAPPI Journal* (Mar. 1983) p. 120.

Gregor and Gregor, "Synthetic—Membrane Technology", Scientific American, (Jul. 1985).

Gupta, et al., "OZ Prebleaching, Influence on Viscosity and Sheet Strength", TAPPI Symposium-Oxygen Delignification, p. 1 (1984).

Heimburger et al., "Kraft Mill Bleach Plant Effluents: Recent Developments Aimed at Decreasing Their Environmental Impact".

(List continued on next page.)

OTHER PUBLICATIONS

Heimburger et al., "Kraft Mill Bleach Plant Effluents: Recent Developments Aimed at Decreased Their Environmental Impact Part II", TAPPI Journal, p. 69 (Nov. 1988).

Hill and Rice, "Handbook of Ozone Technology and Applications", Ann Arbor Science.

Hiraoka et al., "Two Dimensional Model Analysis of Flow Behavior of Highly Viscous Non-Newtonian Fluid in Agitated Vessel With Paddle Impeller", Journal of Chemical Eng. of Japan, p. 56.

Hiraoka et al., "Two Dimensional Model Analysis of Turbulent Flow in an Agitated Vessel With Paddle Impeller", Chem. Eng. Commun., p. 149.

Katai and Schuerch, "Mechanism of Ozone Attack on Alpha-Methyl Glucoside and Cellulosic Materials".

Kibblewhite et al., "Effects of Ozone on the Fibre Characteristics of High-Temperature Thermomechanical Pulp", Proceedings of the 1979 International Mechanical Pulping Conference, p. 293.

Kratzl et al., "Reactions of Lignin and Lignin Model Compounds With Ozone", *Tappi,* vol. 59, No. 11 (Nov. 1976) p. 86.

Leopold, B., "The Pulp Mill of the Future", *Textile and Paper Chemistry and Technology,* p. 239.

Leopold, B., "The Pulping Process—Opportunity or Headache?", Proceedings of IPC Conference, Paper Science and Technology, May 8-10, 1979.

Liebergott et al., "The Use of Ozone or Oxygen in the First Bleaching Stage", *Ozone: Science and Engineering,* vol. 4, p. 109 (1982).

Liebergott, et al., "The Use of Ozone in Bleaching and Brightening Wood Pulps: Part I—Chemical Pulps" (TAPPI 1978), p. 90.

Liebergott, N., "Paprizone Process for Brightening and Strengthening Groundwood", *Paper Trade Journal* (Aug. 2, 1971) p. 28.

Liebergott, N., Technical Paper T214—"Sequential Treatment of Mechanical Pulps at High Consistency with $H_2O_2$ and $O_3$—The Paprizone Process-Effect on Pulp Brightness and Strength", *Pulp and Paper Magazine of Canada,* vol. 73, No. 9, (Sep. 1972) p. 70.

Liebergott, et al. "Bleaching a Softwood Kraft Pulp Without Chlorine Compounds", TAPPI Journal, p. 76 (Aug. 1984).

Liebergott, et al. "Bleaching a Softwood Kraft Pulp Without Chlorine Compounds", pp. 1-10.

Liebergott et al., "Ozone Delignification of Bleach Spruce and Hardwood Kraft, Kraft Anthraquinone, and Soda-Anthraquinone", *TAPPI,* vol. 64, No. 6 (Jun. 1981) p. 95.

Lindholm, "Effect of Heterogeneity in Pulp Bleaching with Ozone", Paperi ja Puu, (Apr. 1986).

Lindholm, "Effect of Pulp Consistency and pH in Ozone Bleaching", Part I.

Lindholm, "Effect of Pulp Consistency and pH in Ozone Bleaching; Part 2", International Oxygen Delignification Conference (1987).

Lindholm, "Effect of Pulp Consistency and pH in Ozone Bleaching", Paperi ja Puu, (Mar. 1987), Part IV.

Lindquist et al., "Ozone Bleaching of Sulfite Pulps", TAPPI Proceedings of the 1982 Inter-national Sulfite Pulping Conference, p. 127.

Lindquist, "Ozone Bleaching of Sulfite Pulps", *Svensk Papperstidning (Nov. 6, 1984) p. 54.*

Loras et al., "Bleaching of Sulphite Pulps With Oxygen and Ozone", Report of 1982 International Pulp Bleaching Conference, p. 45.

Loras, V., "Bleachability of Mechanical Pulp", *Tappi,* vol. 57, No. 2 (Feb. 1974) p. 98.

Mbachu et al., "The Effect of Acetic and Formic Acid Pretreatment on Pulp Bleaching With Ozone", *TAPPI,* vol. 64, No. 1 (Jan. 1981) p. 67.

Melnyk et al., "An Ozone Reactor for Color Removal From Pulp Bleachery Wastes", Chemical Abstracts, p. 434.

Meredith, "Ozone Mass Transfer Agitated Low Consistency", Wood Pulp, Sep. 9, 1981.

Norden and Simonson, "Ozone Bleaching of Sulphite Pulp—A Pilot Plant Study".

*Norsk Skogindustri,* Mechanical Pulp—A Product for the Future.

*Norsk Skogindustri,* "Pilot Scale Research at PFI", (Oct. 1980) p. 228.

Ohnishi, K., "Japan: Pulping, Bleaching", *Pulp and Paper* (Aug. 1978) p. 88.

Ouederni, "Simulation of the Ozone/Lignin Reaction in an Agitated Vessel".

Ow, et al., "Advances In Ozone Bleaching: Part II—Bleaching of Softwood Kraft Pulps With Oxygen and Ozone Combination", TAPPI Symposium—Oxygen Delignification (1984).

(List continued on next page.)

OTHER PUBLICATIONS

Partridge, H., "New Pulp Bleaching Developments", *CEP* (Jun. 1976).

Partridge, H., "An Overview of New Pulp Bleaching Developments" AIChE National Meeting, Paper No. 24a, (Sep. 7–10, 1975).

Patt, et al., "Use of Ozone For Pulp Bleaching", Papier, 42 (10A), V 14–23 (1988).

Perkins et al., "Advances in Ozone Bleaching —Part III—Pilot Plant Installations and Proposed Commercial Implementation".

Pettersson, B. et al. "Advances in Technology Make Batch Pulping as Efficient as Continuous", *Pulp & Paper* (Nov. 1985) p. 90.

PPI, "Naco Straw Pulp", Article, (Apr. 1987).

Procter, A. R., "Ozone for Treatment of High Kappa Kraft Pulps", *Pulp and Paper Magazine of Canada,* vol. 75, No. 6 (Jun. 1974) p. 58.

*Pulp & Paper,* "Ozone Bleaching Has Potential For Closing Pulp Mill Water Systems", (Jul. 1978) p. 76.

Rothenberg S. et al., "Bleaching of Oxygen Pulps With Ozone", p. 175.

Rothenberg S. et al., "Bleaching of Oxygen Pulps with Ozone", *TAPPI Journal* (Aug. 1975) p. 182.

Rothenberg et al., "Ozone Bleaching of Oxygen Pulp", Proceedings of the 1982 Pulping Conference, p. 341.

Rutkowski et al., "Investigations on Bleaching of Sulphate Pine Pulp With Ozone", *Cellulose Chem. Technol.,* vol. 18 (1984) p. 323.

Schuerch, "Ozonization of Cellulose and Wood, Journal of Polymer Science", No. 2, (1963).

Secrist et al., "Kraft Pulp Bleaching. II. Studies on the Ozonation of Chemical Pulps", *TAPPI,* vol. 54, No. 4 (Apr. 1971) p. 581.

Secrist et al., "Studies on the Ozonation of Chemical Pulps", p. 215.

Seifert et al., "Engineering Considerations in the Design of Oxygen Reactors", p. 309.

Singh, "Ozone Replaces Chlorine in the First Bleaching Stage: Advances in Ozone Bleaching—Part I", TAPPI Journal, p. 45 (Feb. 1982).

Singh, "Advances in Ozone Bleaching—Part I: The Ozone Bleaching Process—Laboratory to Pilot Plant".

Smook, "Chapter 6—Sulfite Pulping", Handbook For Pulp & Paper Technologists (TAPPI).

Smook, "Chapter 7—Kraft Pulping", Handbook For Pulp & Paper Technologists (TAPPI).

Soteland, N., "The Effect of Ozone on Mechanical Pulps", Extended Abstracts of 1976 Canadian Wood Chemistry Symposium, p. 13.

Soteland, N., "The Effect of Ozone on Mechanical Pulps", *Pulp and Paper Magazine of Canada,* vol. 78, No. 7 (Jul. 1977) p. 45.

Soteland, N., "Bleaching of Chemical Pulps With Oxygen and Ozone", Pulp and Paper Magazine of Canada, vol. 75, No. 4 (Apr., 1974) p. 91.

Soteland, N., "Bleaching of Chemical Pulps With Oxygen and Ozone," Pulp and Paper Magazine of Canada (1974), p. T–153.

Soteland, N., "Bleaching of Chemical Pulps with Oxygen and Ozone", *Norsk Skogindustri* (Sep. 1978) p. 199.

Soteland, "Comparison Between Oxygen and Ozone Delignification of Sulphite Pulps", TAPPI Symposium–Oxygen Delignification, p. 71 (1984).

Tenda et al., "Mixing Characteristics and Optimum Conditions of a Horizontal Gas–Solid Agitated Vessel With Paddle–Blades on Double Parallel Axes", Kogaku, pp. 1–15.

Tritschler and Shelton, "Commercial Manufacture and Industrial Use of Ozone and an Oxidant".

Vidal and Molinier, "Ozonolysis of Lignin–Improvement of In Vitro Digestibility of Popular Sawdust", Biomass 16, (1988).

Winardi et al., "Pattern Recognition in Flow Visualization Around a Paddle Impeller", Journal of C.E. in Japan, p. 503.

TWO STAGE PULP BLEACHING REACTOR

This is a continuation of application Ser. No. 07/835,790 filed Feb. 14, 1992, now abandoned, which is a division of application Ser. No. 07/705,691 filed May 24, 1991, now abandoned.

BACKGROUND OF THE INVENTION

The present invention relates to a novel apparatus and method for delignifying and bleaching lignocellulosic pulp with a gaseous bleaching agent such as ozone. More particularly, the present invention includes a first stage where pulp and ozone are subjected to high shear mixing and a bleaching reaction occurs, and a second stage where the mixed pulp is held in a retention bed for further reaction and stripping of the ozone from the carrier gas.

To avoid the use of chlorine as a bleaching agent for pulp or other lignocellulosic materials, the use of ozone in the bleaching of chemical pulp has previously been attempted. Although ozone may initially appear to be an ideal material for bleaching lignocellulosic materials, the exceptional oxidative properties of ozone and its relatively high cost have previously limited the development of satisfactory ozone bleaching processes for lignocellulosic materials in general and especially for southern softwoods.

Ozone will readily react with lignin to effectively reduce the amount of lignin in the pulp, but it will also, under many conditions, aggressively attack the carbohydrate which comprises the cellulosic fibers of the wood to substantially reduce the strength of the resultant pulp. Ozone, likewise, is extremely sensitive to process conditions such as pH with respect to its oxidative and chemical stability. Changes in these process conditions can significantly alter the reactivity of ozone with respect to the lignocellulosic materials.

Since the delignifying capabilities of ozone were first recognized around the turn of the century, there has been substantial and continuous work by numerous persons in the field to develop a commercially suitable method using ozone in the bleaching of lignocellulosic materials. Furthermore, numerous articles and patents have been published in this area and there have been reports of attempts at conducting ozone bleaching on a non-commercial pilot scale basis. For example, U.S. Pat. No. 2,466,633 to Brabender et al., describes a bleaching process wherein ozone is passed through a pulp having a moisture content (adjusted to an oven dry consistency) of between 25 and 55 per cent and a pH adjusted to the range of 4 to 7.

U.S. Pat. No. 3,814,664 to Carlsmith discloses a gaseous reaction apparatus including a peripheral gas receiving chamber which is said to be useful for ozone bleaching of pulp. Pulp to be bleached is fed through a tapered, compacting plug conveyor to create a gas seal. The plug is then broken up by a screw disintegrator at which point ozone from a gas tight vessel is mixed with the pulp. The pulp is fluffed and fibers are entrained in the gas which is then directed into a pulp bed in the gas tight vessel for reaction of the pulp and ozone. The carrier gas is removed through an annular discharge chamber and the pulp is retained for at least twenty minutes to allow completion of the bleaching reaction. Dilution liquid is supplied into the bottom of the tank with the pulp and the pulp is discharged from the tank when the reaction is complete.

Two other patents to Carlsmith disclose vessels for containing gaseous reaction beds. In U.S. Pat. No. 3,785,577, pulp is supplied to the vessel first through a compacting screw and then a feed screw, into a mechanism for breaking up the compacted pulp and spreading it across the cross-section of the vessel. The reaction gas is supplied by separate conduit into the vessel. The reacted pulp is removed from the bottom of the vessel by a screw mechanism which forces the pulp through a flap means to recompact the reacted pulp. U.S. Pat. No. 3,964,962 discloses a modification to the '664 and '557 patents discussed above. A gas release zone is provided on the vessel for receiving discharged gas. A system is then provided to direct at least a portion of the discharged gas back into the top of the vessel to supplement the new reaction gas supplied.

Other ozone bleach sequences are described by S. Rothenberg, D. Robinson & D. Johnsonbaugh, "Bleaching of Oxygen Pulps with Ozone", *Tappi*, 182–185 (1975)—Z, ZEZ, ZP and $ZP_a$ ($P_a$-peroxyacetic acid); and N. Soteland, "Bleaching of Chemical Pulps with Oxygen and Ozone", *Pulp and Paper Magazine of Canada*, T153-58 (1974)—OZEP, OP and ZP. Further, U.S. Pat. No. 4,196,043 to Singh discloses a multi-stage bleaching process utilizing ozone and peroxide which also attempts to eliminate the use of chlorine compounds, and includes recycling of effluents.

Various bleaching apparatus utilizing a central shaft with arm members attached thereto are generally known (see, e.g., U.S. Pat. Nos. 1,591,070 to Wolf, 1,642,978 and 1,643,566, each to Thorne, 2,431,478 to Hill, and 4,298,426 to Torregrossa et al.). Also, U.S. Pat. Nos. 3,630,828 to Liebergott et al. and 3,725,193 to de Montigny et al. each disclose a bleaching apparatus for use with pulp having a consistency of above 15 percent, which apparatus includes a rotating shaft having radially spaced breaker arms for comminuting the pulp. Richter U.S. Pat. No. 4,093,506 discloses a method and apparatus for the continuous distribution and mixing of high consistency pulp with a treatment fluid such as chlorine or chlorine dioxide. The apparatus consists of a concentric housing having a cylindrical portion, a generally converging open conical portion extending outwardly from one end of the cylindrical portion, and a closed wall extending inwardly from the other end of the cylindrical portion. A rotor shaft mounted within the housing includes a hub to which a plurality of arms are attached. These arms are each connected to a transport blade or wing. Rotation of the shaft allows the treatment fluid to be distributed in and mixed with the pulp "as evenly as possible."

Fritzvoid U.S. Pat. No. 4,278,496 discloses a vertical ozonizer for treating high consistency (i.e., 35–50%) pulp. Both oxygen/ozone gas and the pulp (at a pH of about 5) are conveyed into the top of the reactor to be distributed across the entire cross-section, such that the gas comes in intimate contact with the pulp particles. The pulp and gas mixture is distributed in layers on supporting means in a series of subjacent chambers. The supporting means includes apertures or slits having a shape such that the pulp forms mass bridges thereacross, while the gas passes throughout the entire reactor in contact with the pulp.

Displacement of pulp through the reactor takes place by the repeated but controlled breaking of the supporting means by the rotation of the breaking means which are attached to and rotated by a central shaft. This allows the pulp to pass through the apertures and into the subjacent chambers. Fritzvoid et al. U.S. Pat. No. 4,123,317 more specifically discloses the reactor described in the aforementioned Fritzvoid '496 patent. This reactor also is used for treating pulp with an oxygen/ozone gas mixture.

U.S. Pat. Nos. 4,468,286 and 4,426,256 each to Johnson disclose a method and apparatus for continuous treatment of paper pulp with ozone. The pulp and ozone are passed along different paths either together or separately.

U.S. Pat. No. 4,363,697 illustrates certain screw flight conveyors which are modified by including paddles, cut and folded screw flights or combinations thereof for use in the bleaching of low consistency pulp with oxygen.

French Pat. 1,441,787 and European patent Application 276,608 each disclose methods for bleaching pulp with ozone. European Pat. Application No. 308,314 discloses a reactor for bleaching pulp with ozone utilizing a closed flight screw conveyor, wherein the ozone gas is pumped through a central shaft for distribution throughout the reactor. The pulp has a consistency of 20–50% and the ozone concentration of the treating gas is between 4 and 10% so that 2 to 8% application of ozone on O.D. fiber is achieved.

In general, the prior art has not achieved a successful reactor or method for ozone bleaching of pulp which provides a substantially uniformly bleached pulp. In slowly moving retention-type beds, such as in the Carlsmith devices discussed above, some of the pulp is isolated from the gaseous bleaching mixture relative to other pulp due to differences in bed height and bulk density at various positions within the bed. This causes non-uniform passage of the bleaching mixture gas through the fiber bed, which in turn results in non-uniform ozone-pulp contact and non-uniform bleaching. Also, mixing at low to medium pulp consistencies is undesirable because of the substantially greater amounts of ozone required to achieve the same level of bleaching due to the ozone being diffused through water.

SUMMARY OF THE INVENTION

The present invention provides a novel apparatus and gaseous bleaching process which overcomes the problems encountered in the prior art as discussed herein to produce a high grade, uniformly bleached pulp.

An objective of the invention is that the pulp be bleached uniformly. A feature of the invention in this regard is high shear mixing of the pulp in the presence of a gaseous bleaching mixture containing ozone to ensure approximately equal and uniform access of the ozone to all pulp particles.

The term "bleaching" in this application is intended to mean the reaction of pulp with an agent to obtain an increase in brightness, remove lignin and obtain a decrease in K No., without detrimentally affecting the viscosity of the pulp.

According to the present invention, a low consistency pulp to be ozone bleached is first mixed with acidifying and chelating agents to maximize ozone consumption by the pulp. The pulp is then thickened to a consistency of greater than 20%. A comminuting device reduces the pulp particles to a size sufficient to allow substantially complete penetration by the ozone, for example less than ten millimeters. The high consistency pulp is directed into the comminuting device by a tapered conveyor to compact the pulp in a plug-like manner to form a gas seal. A gaseous bleaching mixture containing ozone is first introduced to the pulp in the comminuting device or immediately after it. The pulp and gaseous bleaching mixture travel cocurrently through the reactor first stage. The pulp is transported directly from the comminuting device into a two stage reactor according to the present invention.

In the first stage of the reactor of the present invention, the high consistency pulp is subjected to high shear mixing with the gaseous bleaching mixture to mix and contact substantially all of the pulp particles with the gaseous bleaching mixture and to react at least a portion of the pulp with the ozone in the first stage. Preferably, substantially all of the pulp reacts in the first stage. The first stage also transports the pulp to the second stage.

The second stage,according to the present invention includes a retention vessel with an essentially quiescent pulp bed disposed therein. Pulp particles, contacted with ozone in the first stage, may complete their bleaching reaction in the pulp bed. Additionally, the gaseous bleaching mixture containing unreacted ozone is drawn through the pulp bed. This ozone contacts the pulp for further reaction in order to further bleach the pulp. Due to the high cost of ozone, it is preferable to consume as much ozone as possible in bleaching. The further reaction of the pulp with ozone in the second stage consumes substantially all remaining ozone, thus stripping the ozone from the gaseous bleaching mixture.

The ozone stripped gaseous bleaching mixture is then removed from the second stage after entrained pulp fibers are eliminated from the gas. The bleached pulp moves downward into dilution water to quench the bleaching reaction and provide the pulp with a low consistency to facilitate movement to subsequent processing steps.

Devices suitable for imparting the high shear mixing and contacting of pulp and gaseous bleaching mixture in the first stage include steam mixers, extruders, screw defibrators, cut-and-folded screw flight conveyors, or other devices which are capable of lifting, tossing and agitating the pulp into the gaseous bleaching mixture, while conveying the pulp from the comminuting device to the second stage.

DETAILED DESCRIPTION OF THE PREFERRED EMBODIMENTS

Figure 1:
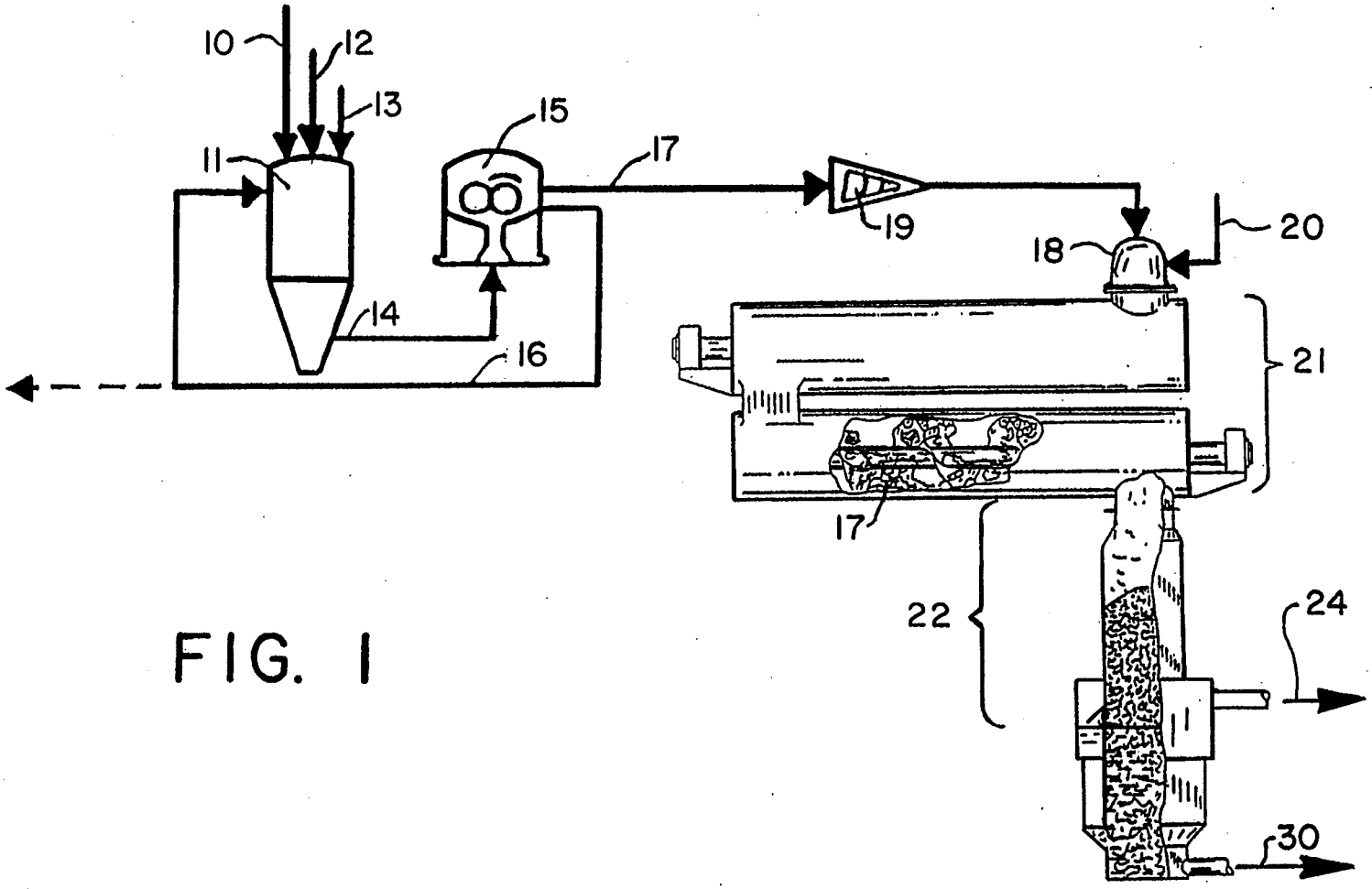
FIG. 1 is a flow diagram illustrating the general arrangement of the components of the present invention.

FIG. 1 illustrates the process and apparatus according to the invention in general terms. Pulp 10 is directed through a number of pre-reactor conditioning steps. In the pre-conditioning, washed pulp 10 first enters mixing chest 11 where it is conditioned by treatment with acid 12 and chelating agent 13. The acidified and chelated pulp 14 preferably has a target pH of approximately 2 to increase the efficiency of ozone consumption by the pulp. Pulp 14 is a low consistency pulp at this stage and is pumped into thickening unit 15, such as a twin roll press. Thickening unit 15 removes excess liquid 16 from the pulp and raises the consistency to the desired level, greater than 20% consistency. Preferred consistency is generally between 38 to 48%. A substantial portion of excess liquid 16 can be recycled into mixing chest 11, although a portion (shown by the dotted line) may be discharged to maintain the liquid balance of the system.

High consistency pulp 17 is directed into a comminuting unit 18, such as a fluffer, via a tapered screw plug conveyor 19 to provide a gas seal in a known manner. In the present invention, the arrangement of the fluffer and tapered screw is similar to that in U.S. Pat. No. 3,964,962, except the fluffed pulp falls into the first stage reactor as described herein and not into a conventional bed reactor. Comminution by the fluffer 18 creates discrete pulp particles of a sufficient size and of a sufficiently low bulk density to allow the ozone gas mixture to completely penetrate a majority of the pulp particles in the first stage reactor. A particle size of less than about 5 mm has been found to be most preferable. However, sufficient particle size depends also on bulk density and generally a particle size of 10 mm or less will be suitable if the bulk density is low enough.

Gaseous bleaching mixture 20, containing ozone, is initially added to pulp 17 at or immediately below the comminuting unit 18. The pulp 17 and gaseous bleaching mixture 20 then flow cocurrently into reactor first stage 21.

The ozone gas which is used in the bleaching process may be employed as a mixture of ozone with oxygen and/or an inert gas, or as a mixture of ozone with air. The amount of ozone which can satisfactorily be incorporated into the gaseous bleaching mixture is limited by the stability of the ozone in the mixture. A preferred mixture is about 3–6% ozone with the balance predominantly oxygen. This amount is determined, at least in part, by the amount of lignin which is to be removed during the ozone bleaching process, balanced against the relative amount of degradation of the cellulose which can be tolerated during ozone bleaching. Preferably, an amount of ozone is used which will react with about 50% to 70% of the lignin present in the pulp.

First stage 21 comprises a high shear mixing and contacting vessel where high shear mixing of the high consistency pulp 17 and the ozone containing gaseous bleaching mixture takes place. High shear mixing involves a turbulent turning over of the pulp as it is moved through a mixing device or reactor, such that substantially all of the pulp is at one point or another lifted, tossed, or otherwise agitated in the presence of the ozone containing bleaching mixture. It is not necessary, however, to fluidize the pulp particles in the gaseous bleaching mixture because such high shear mixing has been found sufficient to provide a uniformly bleached pulp.

The ozone-lignin bleaching reaction is a contact reaction. The reaction on any individual pulp particle begins almost immediately when the lignin and ozone are contacted and is relatively quick to completion. There is, however, a slight delay from when the pulp particle itself is exposed to the ozone containing gaseous bleaching mixture to when the lignin is actually contacted by the ozone. The delay is due to the lignin being located primarily inside the pulp particle and the time required for ozone to pass through outer pulp fibers and water retained by the pulp fibers to the lignin. For these reasons, complete and uniform mixing of the pulp with the ozone in the first stage reactor is essential to achieving uniform brightness of the bleached pulp.

Devices suitable for use as the high shear mixing and contacting vessel include a steam mixer, an extruder, a screw defibrator, such as a Frotopulper TM device, or a cut-and-folded screw flight conveyor.

Figure 2:
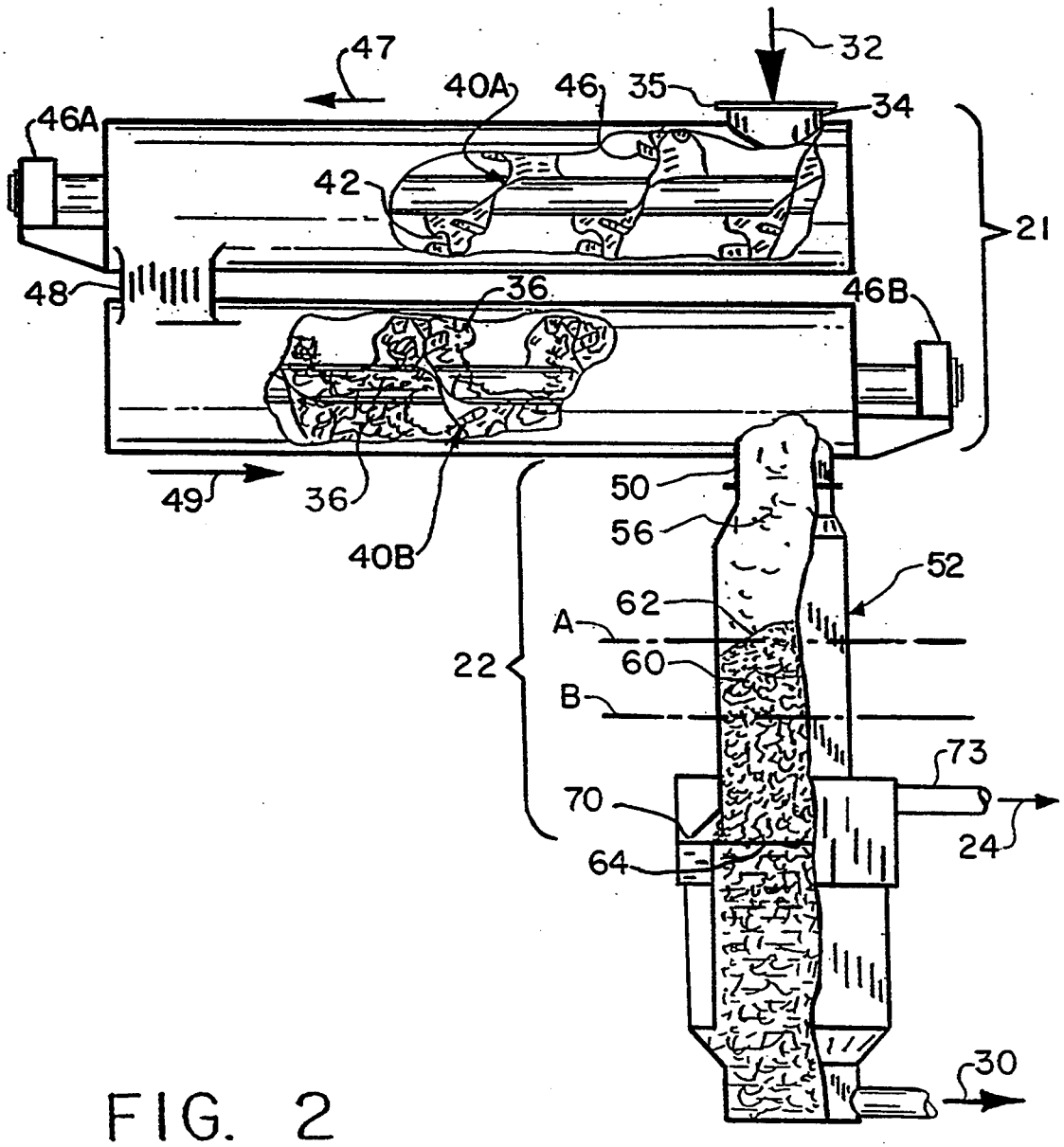
FIG. 2 is a schematic diagram of a preferred embodiment of the present invention.

A preferred embodiment according to the present invention is schematically illustrated in FIG. 2. Conditioned, high consistency pulp and the cocurrent gaseous bleaching mixture (shown collectively as 32) are introduced into the reactor first stage 21 which, in a preferred embodiment, comprises a cut-and-folded screw flight conveyor as shown. Such a conveyor includes a housing with a flange 35 and supporting wall 34 forming an inlet. The fluffer/comminuter 18 utilized in the pre-reactor conditioning may be mounted at the inlet end of a cut-and-folded screw flight conveyor, for example by bolting directly to flange 35.

The conveyor also serves as the first stage reactor vessel where pulp fiber particles 36 are mixed and substantially uniformly contacted with the gaseous bleaching mixture to contact substantially all of the pulp with the ozone. For this embodiment, a single rotating shaft is mounted in the housing with a continuous screw flight on the shaft. Portions are cut from the flight to form openings and the cut portions are bent at a predetermined angle with respect to the shaft.

A typical cut-and-folded screw flight design is shown at 40A or 40B in FIG. 2. Pulp has been omitted from upper screw flight only in order to more clearly show the cut-and-folded design. Open portions 42 of the flight permit the gaseous bleaching mixture to freely flow therethrough, while folded portions 46 cause both radial distribution of the gas and the appropriate high shear lifting, tossing and/or agitating of the pulp in the gas to obtain the desired uniform contact of ozone on pulp. Also, the gaseous bleaching mixture is induced by the conveyor flights to flow and surround the pulp fiber particles so that all surfaces of the particles are exposed to the ozone for substantially complete penetration. These features allow the pulp fiber particles to be substantially uniformly contacted and bleached by the ozone in the first stage.

In the preferred embodiment of FIG. 2, the conveyor/reactor includes two separate flights 40A and 40B. The pulp moves in the direction of arrow 47 until it reaches the end of upper flight 40A, at which time it drops through a conduit, in the form of chute 48, onto lower flight 40B. Lower flight 40B moves the pulp in the direction of arrow 49, towards second stage 22. The shafts of flights 40A and 40B are driven by individual motors 46A and 46B, respectively. Alternatively, a single motor could be employed with the shafts coupled together. At the end of lower flight 40B, the pulp drops through outlet 50 and into the reactor second stage, indicated at 22.

The degree of bleaching which occurs in the first stage can be controlled by varying factors such as ozone concentration, residence time of the pulp in the first stage and amount of pulp in the first stage. The degree of bleaching is conveniently gauged by percentage of available ozone which is consumed in the first stage. This percentage will be within the range of about 50–90%, with usually at least about 60% and more frequently about 70% of the ozone consumed in the first stage reactor.

The residence time of the pulp particles in the first stage is primarily dependent upon the size and type of conveyor utilized for that stage. For the equipment described herein, the pulp residence time in the first stage generally ranges from about 40 to 180 seconds, preferably between about 80 to 120 seconds.

The entire amount of lignin removed, evidenced by the final K No., should be such that the ozone does not react excessively with the cellulose to substantially decrease the degree of polymerization of the cellulose. Preferably, the amount of ozone added, based on the oven dried weight of the pulp, typically is from about 0.2% to about 2% to reach the desired lignin levels. Higher amounts may be required if significant quantities of dissolved solids are present in the system. Since ozone is relatively expensive, it is advantageous and cost effective to utilize the smallest amounts necessary to obtain the desired bleaching, and to consume as much ozone as possible.

From reactor first stage 21, the pulp and ozone containing bleaching mixture pass into reactor second stage 22, as shown in FIG. 2. Reactor second stage 22 comprises a retention vessel 52 which receives the ozone contacted high consistency pulp 56 and the unreacted ozone leaving the first stage. Pulp 56 falls into the retention vessel 52 to form an essentially quiescent pulp bed 60.

The term "retention" is intended to mean quiescent or very slowly axially moving, so that material in the retention vessel is retained therein with very little movement. Thus, there is no high shear mixing or other significant agitation in this vessel 52, compared to that of the first stage 21. Such agitation is unnecessary in the second stage because the pulp and ozone have been substantially uniformly mixed and contacted.

Ozone leaving first stage 21 passes through bed 60 to provide maximum contact time with the pulp and strip as much of the residual ozone (i.e., ozone not contacted on pulp particles in the first stage) as possible by providing further opportunities to react with pulp particles. To ensure uniform bleaching, the pulp may be retained in bed 60 only briefly. This minimum time must be long enough to allow any pulp particles contacted by ozone in the first stage, but not completely reacted, to finish their reaction. The residence time is extended to provide for stripping of the remaining available ozone. Ozone stripped gas 24 is then discharged from reactor second stage 22.

A uniform brightness is achievable by the end of second stage 22 because of the high shear mixing and initial reaction in first stage 21. The subsequent reaction to completion which occurs in the second stage ensures an economical process by fully utilizing the ozone available.

The residence time in the second stage can be controlled by controlling the height of bed top 62 above water level 64 and the rate of bleached pulp 30 removal. A retention time in bed 60 of greater than about 17 minutes will not generally be required for pulp bleaching or stripping purposes. Longer retention times may be used for non-reaction purposes, such as when the retention vessel 52 is utilized as a pulp accumulator. Retention times between about 5 to 30 minutes, and more preferably about 10 to 25 minutes will produce satisfactory results in overall bleaching and uniformity.

As shown in FIG. 2, dilution water is introduced through an inlet (not shown) and fills the bottom of vessel 52 to serve as an ozone gas seal at the lower end of second stage 22. Water level 64 thus defines the lower extent of reactor second stage 22. The water also reduces the consistency of the pulp to a low level to facilitate movement of the bleached pulp 30 through subsequent process steps.

The gaseous bleaching mixture, substantially stripped of ozone and containing primarily oxygen and amounts of bleaching reaction by-products, is received in release zones 70 for recovery and drawn into outlet pipe 73. From this point, the recovered gas 24 can be directed to a gas recycle stream.

Figure 12:
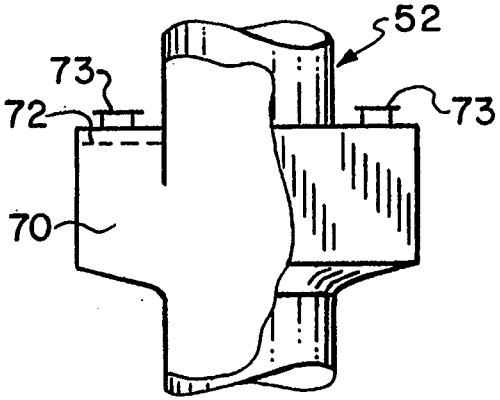
FIG. 12 is a partial cross-sectional view of an alternative gas release zone configuration for the second stage reactor according to the present invention.

In an alternative embodiment, the gas release zones 70 are provided with a cross-sectional area large enough to reduce gas velocity below the entrainment velocity of typical pulp fibers, as shown in FIG. 12. Any fibers which remain entrained can be removed by fiber retention screens 72 as the gas is drawn into outlet pipes 73.

Figure 3:
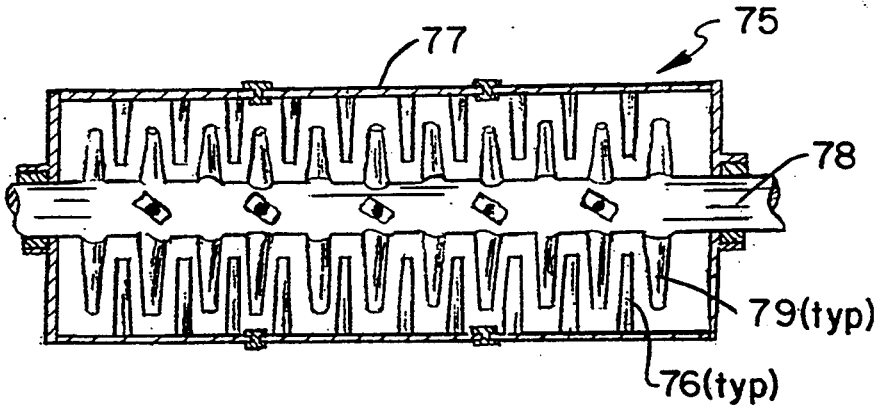
FIG. 3 is a cross-sectional side view of a steam mixer which may be used as the first stage reactor of the invention.
Figure 4:
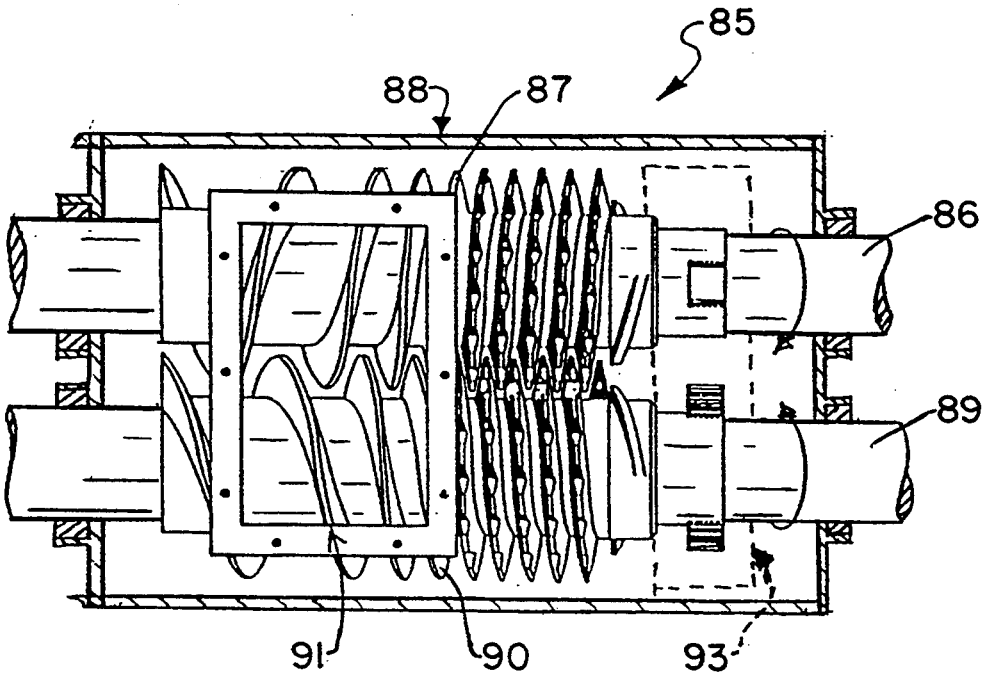
FIG. 4 is a partial cross-sectional top view of a Frotopulper TM screw defibrator device which may be used as the first stage reactor of the invention.
Figure 11:
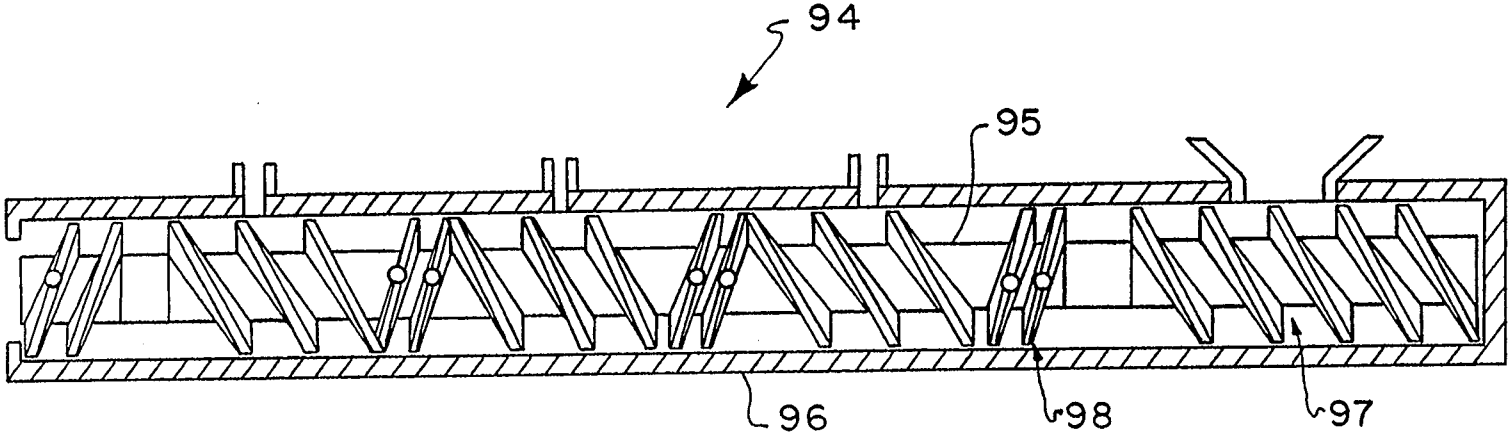
FIG. 11 is a cross-sectional side view of an extruder which may be used as the first stage reactor of the invention.

Instead of the preferred cut-and-folded screw flight conveyor, it is also possible to utilize a mixing device of the type shown in FIG. 3, a screw defibrator of the type shown in FIG. 4 or a device sometimes referred to as an extruder of the type shown in FIG. 11 for first stage 21 of the present invention.

The mixer 75 of FIG. 3 includes a generally cylindrical shell 77 with a central shaft 78 having a plurality of rotor elements 79 extending therefrom. This type mixer is commonly utilized for the steam heating of pulp and is generally referred to as a steam mixer.

Each rotor element preferably has a trapezoidal shape which is wider at the portion attached to the shaft 78 than the opposite end. Moreover, each rotor element 79 is mounted upon the shaft at an angle with respect to the longtitudinal axis of the shaft, and is spaced radially from adjacent elements both about the circumference of the shaft and along the shaft axis. The number of rotor elements in each circumferential arrangement can be the same or, as shown, can differ. FIG. 3 illustrates the use of alternating adjacent longitudinal arrangements, with either two or four rotor elements.

The mixer shell 77 also includes a plurality of elements 76 mounted in circumferential alignment on the inside of the shell 77 which extend toward the shaft 78 and are spaced between the circumferential arrangements of rotor elements 79. These elements 76, for convenience, are about the same size and shape as rotor elements 79.

Other steam mixers can also be used in the invention, such as those described in U.S. Pat. Nos. 4,295,925 or 4,298,426. Also, the exact number, configuration, arrangement and shape of the elements 76, 77 can be selected to achieve the desired high shear mixing. Thus, cylindrical or frustoconical bars or other shapes would be useful as elements 76, 77. All similar shaped and sized-elements or mixtures thereof can be utilized. The exact configuration or arrangement of the elements 76, 77 may vary provided that the pulp is properly mixed with the gaseous bleaching mixture and bridging of the pulp is substantially avoided. The arrangement shown in FIG. 3 achieves such dispersal, with elements 76 preventing bridging of the pulp while the shaft 78 is rotated. Other arrangements could also be used.

Another device which is useful as the first stage reactor 21 of the present invention is the pulp defibrator 85 shown in FIG. 4. Defibrator as used herein is intended only to be descriptive of devices known in the art as such. It is not intended to mean that the device must actually defibrate pulp when used in connection with the present invention. Defibrator 85 includes an outer shell 88 for housing two parallel rotating shafts 86, 89 having meshing screw flights 87, 90 of opposite hand. Thus, shaft 86 is rotated in the opposite direction to that of shaft 89 to achieve proper meshing of the flights. Outer shell 88 includes a pulp inlet 91 and pulp outlet 93. Thus, the pulp particles introduced into inlet 91 are subjected to high shear as they pass through the device toward outlet 93.

One type of useful defibrator is known in the art as a Frotopulper TM device. Other screw defibrators, such as that disclosed in U.S. Pat. No. 3,533,563, however, can also be utilized as the first stage reactor 21 of this invention.

Also useful for the first stage of the present invention are devices sometimes referred to in the art as extruders shown at 94 in FIG. 11. Extruders contemplated for use in the present invention include devices comprising meshing double screws 95 contained within a gas tight housing 96. The screws may be provided with alternating pulp expanding and compacting zones as shown in FIG. 11 at 97 and 98, respectively. Such a device is disclosed in European patent application No. 0 276 608.

A common feature of each of the above mentioned devices is their capability of subjecting the pulp to high shear mixing by lifting, tossing, and/or agitating the high consistency pulp in the presence of a gaseous bleaching mixture containing ozone to achieve a substantially homogeneous mixture of ozone and pulp.

Although the reactor of the present invention can be utilized to bleach a wide variety of different pulps, a desirable range of initial pulp properties entering the reactor for softwood or hardwood pulp would be a K No. of 10 or less, a viscosity of greater than about 13 cps and a consistency of above 20% but less than 60%. After bleaching the pulp as described herein, the pulp exiting the ozone reactor has a GE brightness of at least about 45% and generally about 45% to 70%, with softwoods usually being above 45 and hardwoods usually being above 55%. The pulp (for hardwoods or softwoods) also has a viscosity of greater than about 10 and a K No. of about 5 or less.

The high shear mixing of the present invention provides high penetration and substantially uniform contact of ozone with pulp, prior to introduction into bed 60. The present invention also allows greater than about 50% and preferably 60–75% or more of the pulp particles to be reacted with ozone to completion in the first stage. Since a majority of the pulp particles are substantially bleached in the first stage, the overall brightness of the pulp exiting the first stage approaches 60–75% of the desired final brightness. Even if the residual ozone is not completely uniformly mixed with the pulp particles in the bed, the overall brightness of the final bleached pulp is more uniform compared to bed processess of the prior art because the pulp entering the second stage already has been bleached approximately 70% toward the desired level. For this reason, it is desirable to obtain the greatest reaction of ozone and pulp particles in the first stage to obtain the greatest bleaching uniformity of the pulp. By comparison, where ozone is added to a conventional bed, the pulp must be entirely bleached in the bed and variations in bleaching due to the non-homogeneous mixing of ozone and pulp cause greater differences and non-uniformity in the final brightness of the pulp.

EXAMPLES

The scope of the invention is further described in connection with the following examples, which are set forth for purposes of illustration only and which are not to be construed as limiting the scope of the invention in any manner. Unless otherwise indicated, all chemical percentages are calculated on the basis of the weight of oven dried (OD) fiber. Also, one skilled in the art would understand that the target brightness values do not need to be precisely achieved, as GEB values of plus or minus 2% from the target are acceptable. Also, average brightness values may vary slightly depending on the location where samples were taken, for example, as between bed samples and reactor discharge. This variation is due to the fact that it was not possible to take brightness samples over the entire bed cross-section. If precise and complete sampling were possible, these inconsistencies should disappear.

In the examples that follow, the first stage of the reactor comprised a cut-and-folded screw flight conveyor having two flights as shown in FIG. 2. The diameter of the flights was about 19 inches and each flight was approximately nine feet long. A half pitch design was used for the conveyor. The fill level of pulp in the first stage conveyor/reactor was generally about 25%. The second stage of the reactor was also substantially the same as shown in FIG. 2. Also, the fluffer employed comminuted pulp particle size down to about 4 mm.

Example 1

In this example, the pulp is a fluffed and oxygen bleached low kappa pine, having a K No. of about 8 or less. Pre-reactor conditioning resulted in a viscosity of greater than about 14 cps, a consistency of about 42%, an entering brightness of about 41% GEB, and a pH of slightly less than about 2. The tonnage of pulp through the reactor was about 15 tons per day (tpd). The conveyor of the first stage was rotated at about 20 rpm to provide a residence time for pulp in the first stage of approximately 115 seconds. The pulp bed in the second stage was maintained at a height of approximately 3 feet above the gas release zone, which resulted in a retention time of about 17 minutes. The cocurrent gas flow was at a rate of about 50–60 scfm with an entering ozone content of approximately 3.5 to 4 wt %.

A target brightness of 56% GEB was selected for the pulp discharged from the reactor second stage. Under the above conditions, the reactor according to the present invention achieved an average reactor discharge brightness of about 56.6% GEB. The average K No. at discharge was reduced to about 3.6. In achieving this improved brightness, about 71% of the available ozone was consumed in the reactor first stage and an additional 22% was consumed in the reactor second stage, for a total consumption of about 93% of the available ozone.

Example 2

This example was run under substantially the same conditions as described in the first paragraph of Example 1 above, except the tonnage in this example was about 8–10 tpd. Also, the entering brightness of the pulp was slightly less, at about 39% GEB.

Again, a target brightness of 56% GEB was selected for the pulp discharged. Under these conditions, the present invention achieved an average discharge brightness of about 54.1% GEB. The average K No. at discharge was reduced to about 3.9. The amounts of available ozone consumed in the first and second stages was also approximately the same as in Example 1.

In addition to sampling at the reactor discharge, bed samples were taken to determine the uniformity in bleaching throughout the bed. Seventeen samples were pulled from the bed across its cross-section, at two different levels:

Level A, located approximately at A in FIG. 2, about 3 feet above the gas release zone approximately along the top surface of the bed. This corresponds to sample locations 1–10 shown in FIG. 5A.

Level B, located approximately at B in FIG. 2, about 1½ feet above the gas release zone. This corresponded to sample locations 11–17 shown in FIG. 5B.

For the purposes of comparison, a conventional bed reactor such as disclosed in U.S. Pat. No. 3,964,962 was also used for ozone bleaching of generally the same quality pulp with an entering brightness of about 35.1% GEB, an ozone gas flow of 173 scfm at 2.5 wt % concentration of ozone, a 38% consistency and a bed height of about 8.8 feet. The tonnage in the conventional bed reactor was about 15 tpd. The operational parameters of the conventional bed reactor were selected based on the knowledge of those skilled in the art to provide optimum results with the reactor used. Samples were taken at approximately the same location in the bed as shown in FIGS. 5A and 5B.

Figure 5A:
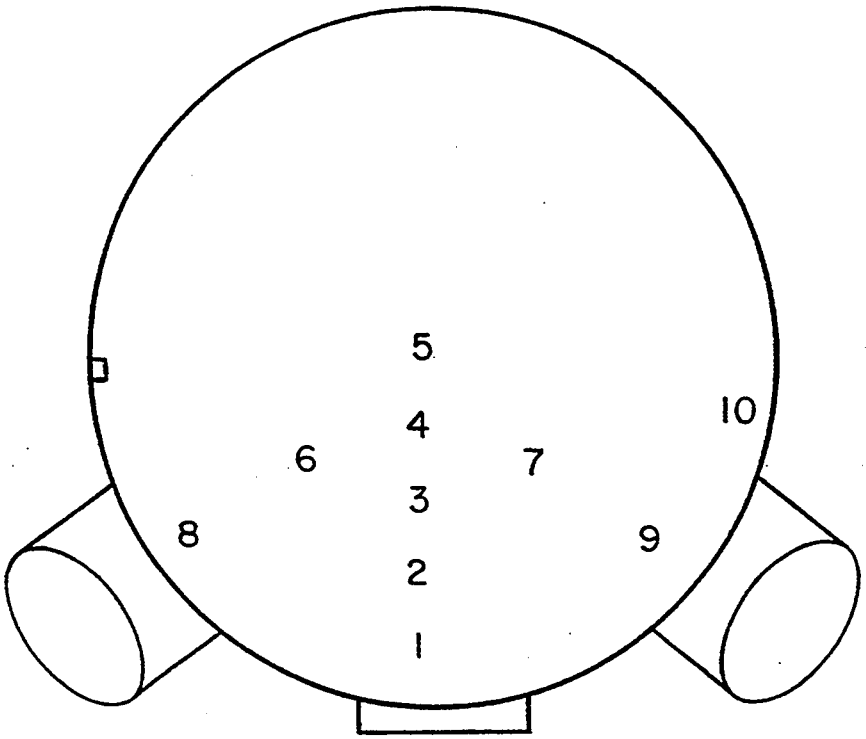
FIGS. 5A and 5B are cross-sectional views of the pulp bed and retention vessel shown in FIG. 2 at levels A and B, respectively, showing the bed sampling locations for brightness uniformity comparison as in Example 2.
Figure 5B:
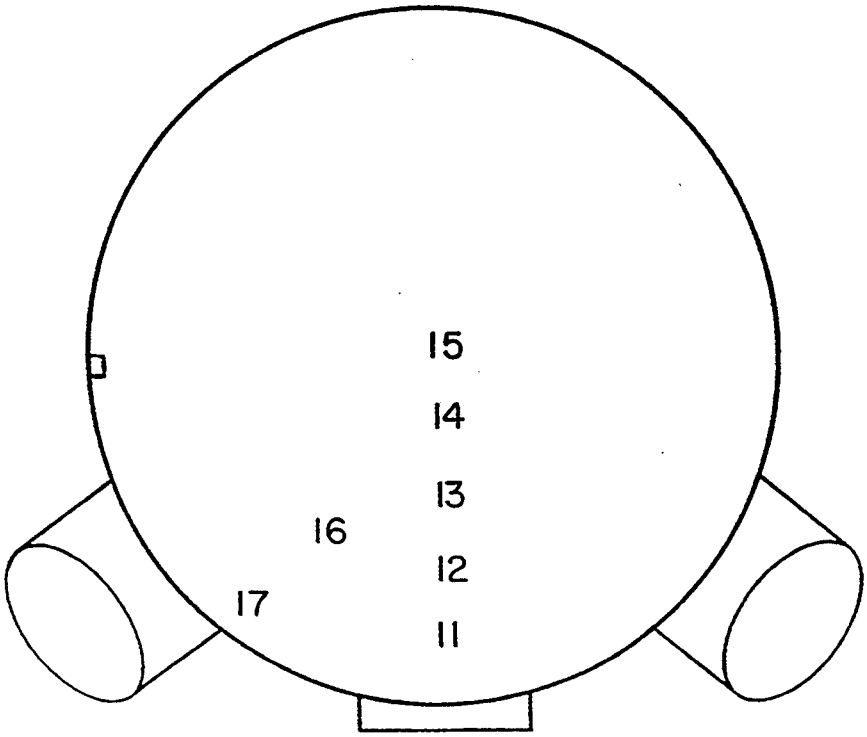
Figure 6A:
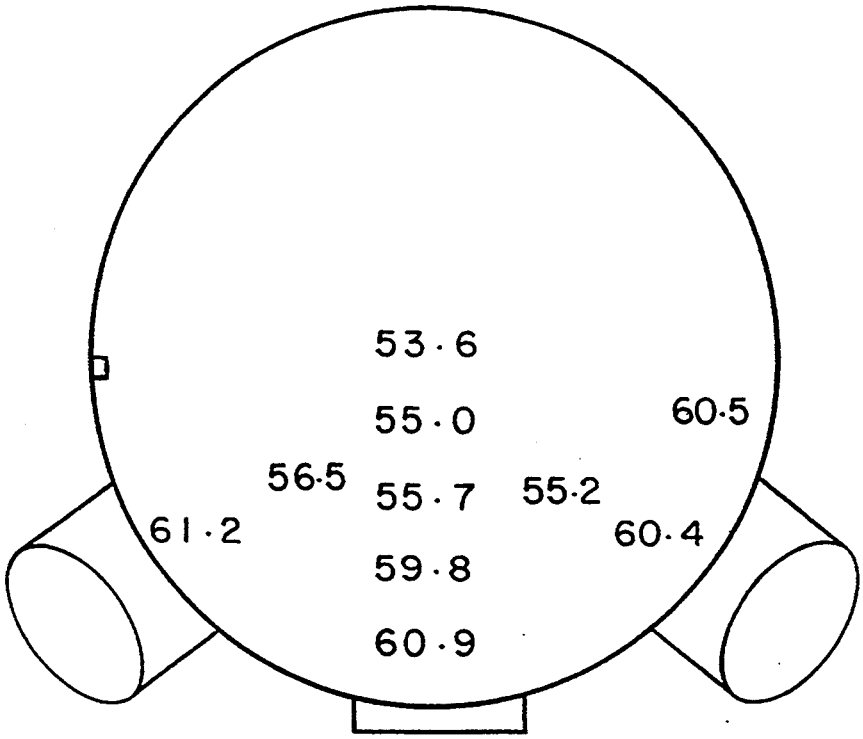
FIGS. 6A and 6B show the GE brightness values at the locations shown in FIGS. 5A and 5B for a two stage reactor according to the present invention.
Figure 6B:
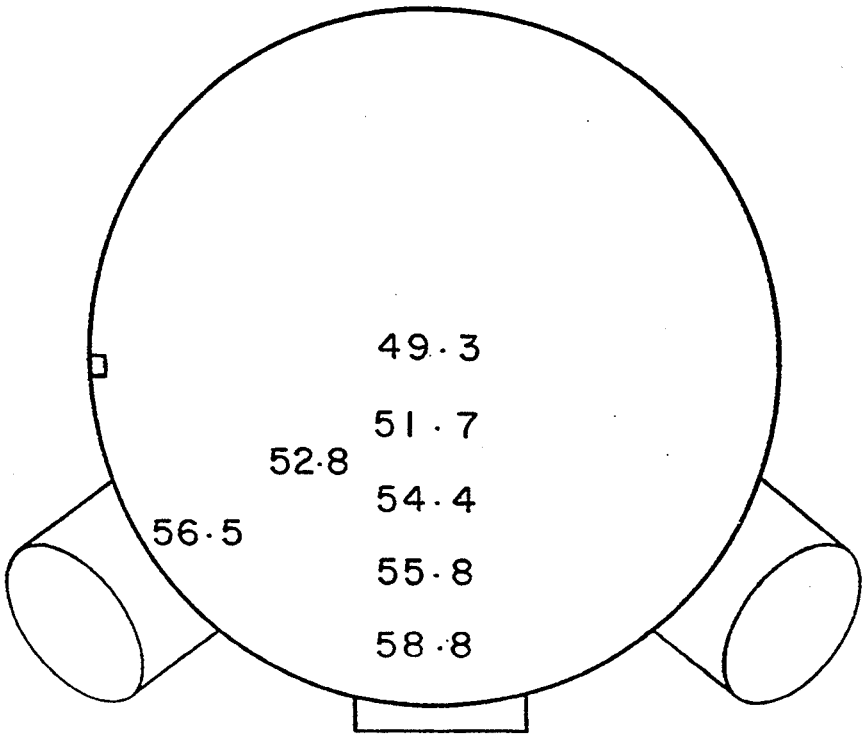
Figure 7A:
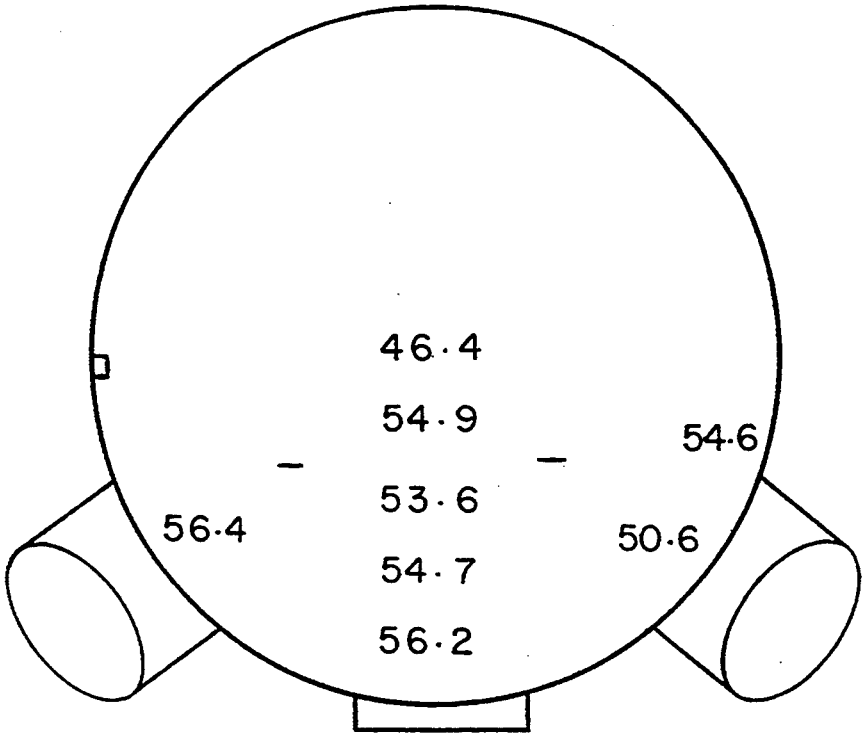
FIGS. 7A and 7B show the GE brightness values at the locations shown in FIGS. 5A and 5B for a conventional bed reactor.
Figure 7B:
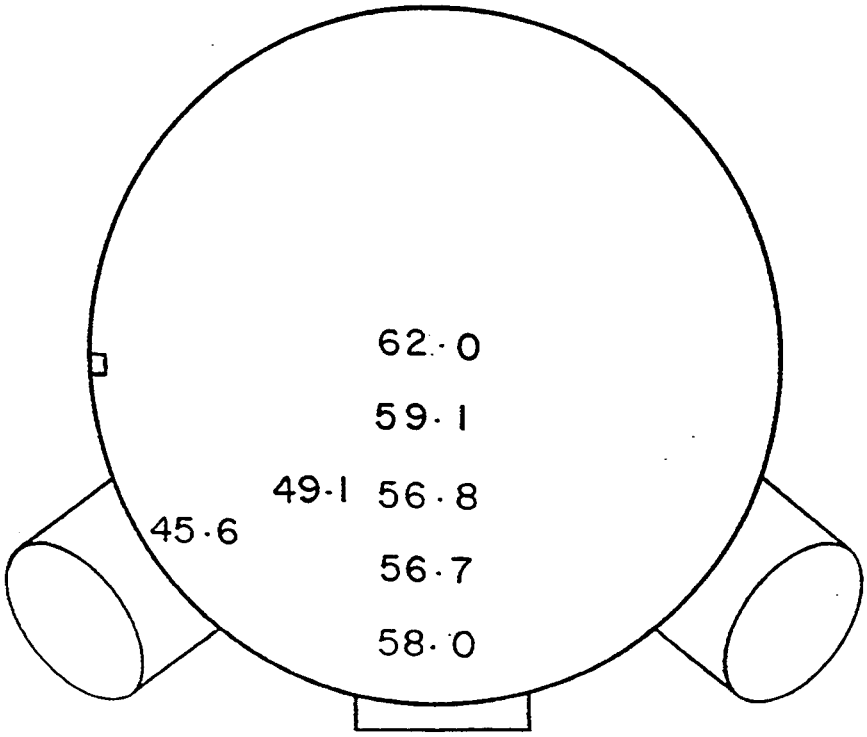

FIGS. 6A and 6B show the brightness distribution in the second stage bed according to the present invention, for the sampling locations illustrated in FIGS. 5A and 5B, respectively. FIGS. 7A and 7B show the same data for the conventional bed reactor. The data are summarized and compared in Table I, below. As is apparent from a comparison of FIGS. 6 and 7, and from Table I, the present invention provides improved macroscopic uniformity by utilizing a two stage bleaching process and reactor as described herein.

TABLE I

| | Two Stage Reactor of Present Invention | Conventional Bed Reactor |
|---|---|---|
| Average Brightness | 56.4 | 54.3 |

TABLE I-continued

| | Two Stage Reactor of Present Invention | Conventional Bed Reactor |
|---|---|---|
| in Bed | | |
| Standard Deviation of Brightness | 3.4 | 4.4 |
| High Brightness Sample | 61.2 | 62.0 |
| Low Brightness Sample | 49.3 | 45.6 |
| Range of Brightness (High-Low) | 11.9 | 16.4 |

Example 3

This example was similar to the previous examples except that a hardwood pulp was used. The hardwood pulp had a K No. of about 5 or less. The pre-reactor conditioning provided a viscosity of greater than about 10 cps, a consistency of about 42% and an entering brightness of about 47% GEB. Again, the pulp was acidified to a pH of slightly less than about 2. The pulp tonnage in this example was 8 tpd. The conveyor of the reactor first stage was rotated at about 21 rpm to provide a first stage residence time of slightly less than about 115 seconds. The bed height was also maintained at about 3 feet in the second stage, again for a retention time of about 17 minutes. The cocurrent gas flow was at a rate of about 30 scfm with an entering ozone concentration of between about 4–5 wt %.

A target brightness of 63% GEB was selected and the entering ozone concentration was varied slightly within the above range to maintain the target. Under these conditions the average reactor discharge brightness was about 65.6% GEB. The average K No. at discharge was reduced to about 1.65. About 63–65% of the available ozone was consumed in the reactor first stage and an additional 25–32% was consumed in the second stage for a total consumption of about 90–95% of the available ozone over the course of the experiment.

As in Example 2, bed brightness samples were taken from the present invention and compared with the results obtained in the conventional bed reactor. The operating condition in the conventional bed reactor were an entering brightness of about 32.6% GEB, an ozone gas flow of about 176 scfm at 2.5 wt % concentration of ozone, a 42% consistency and a bed height of 8.5 feet. The tonnage in the conventional bed reactor was again about 15 tpd.

Figure 8A:
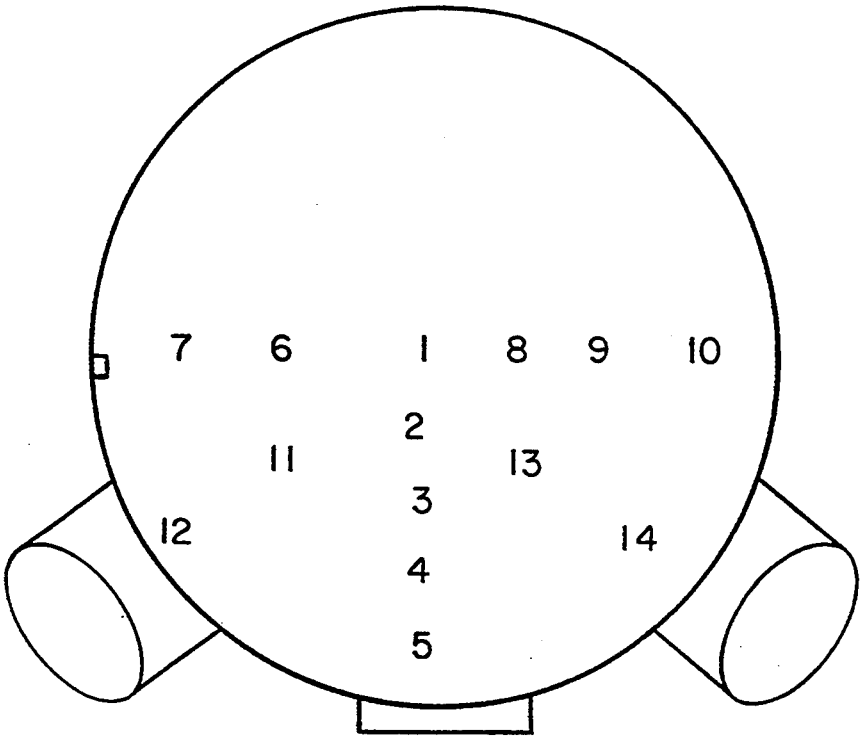
FIGS. 8A and 8B are cross-sectional views of the pulp bed and retention vessel shown in FIG. 2 at levels A and B, respectively, showing the bed sampling locations for brightness uniformity comparison as in Example 3.
Figure 8B:
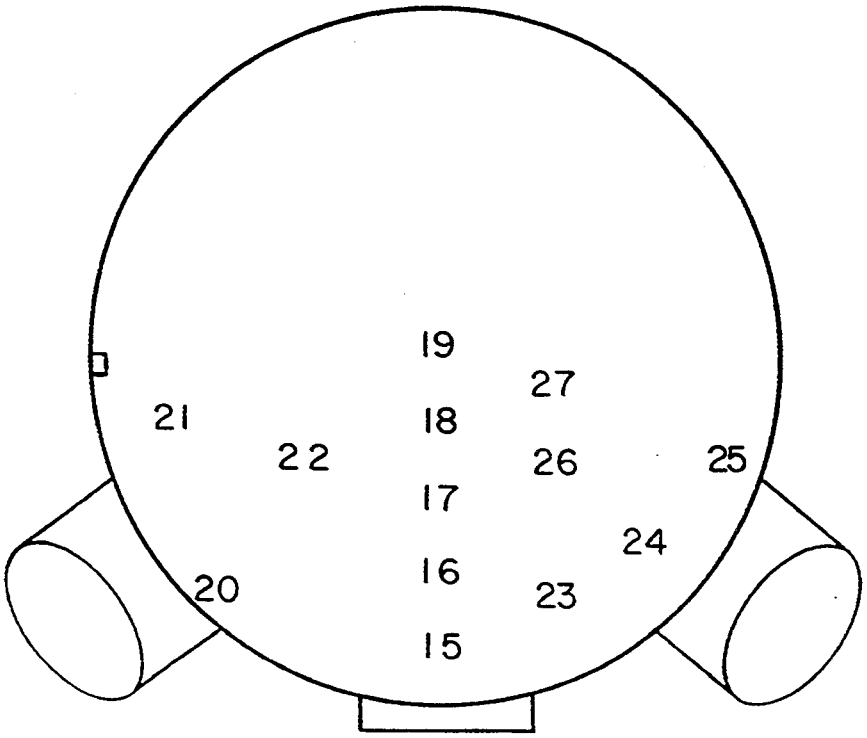
Figure 9A:
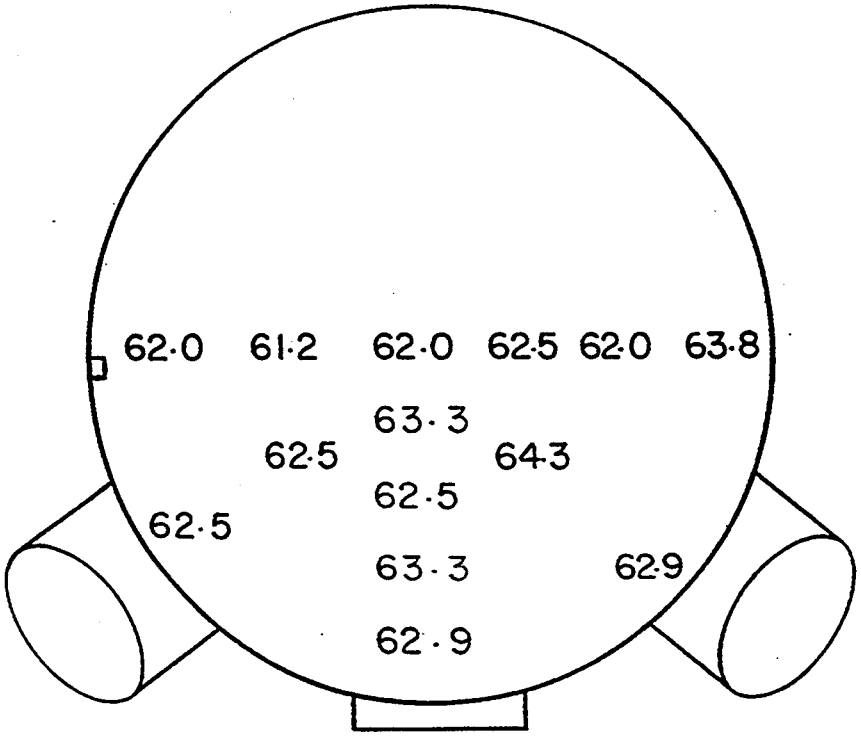
FIGS. 9A and 9B show the GE brightness values at the locations shown in FIGS. 8A and 8B for a two stage reactor according to the present invention.
Figure 9B:
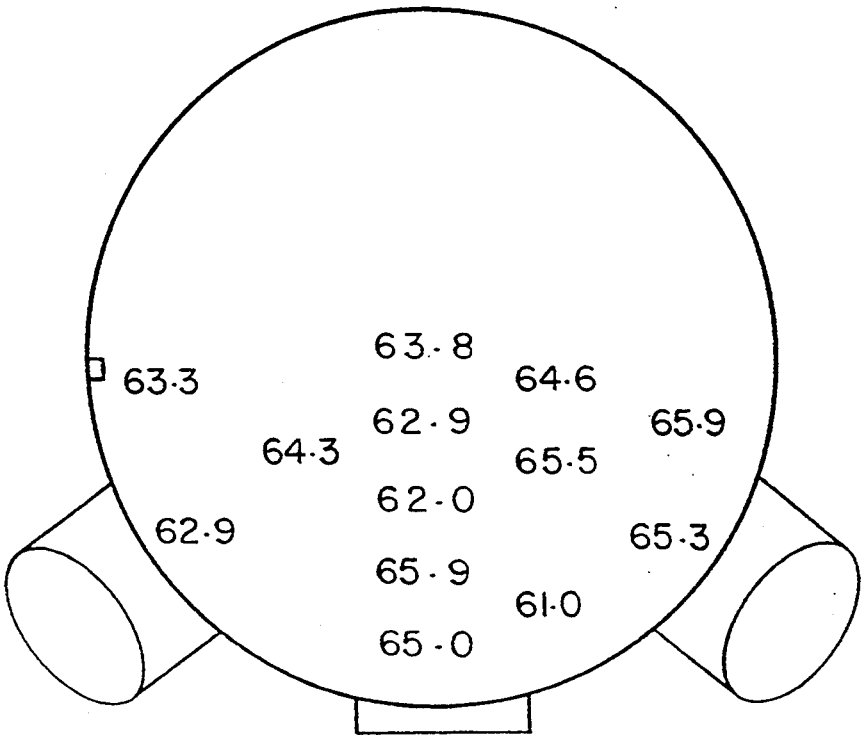
Figure 10A:
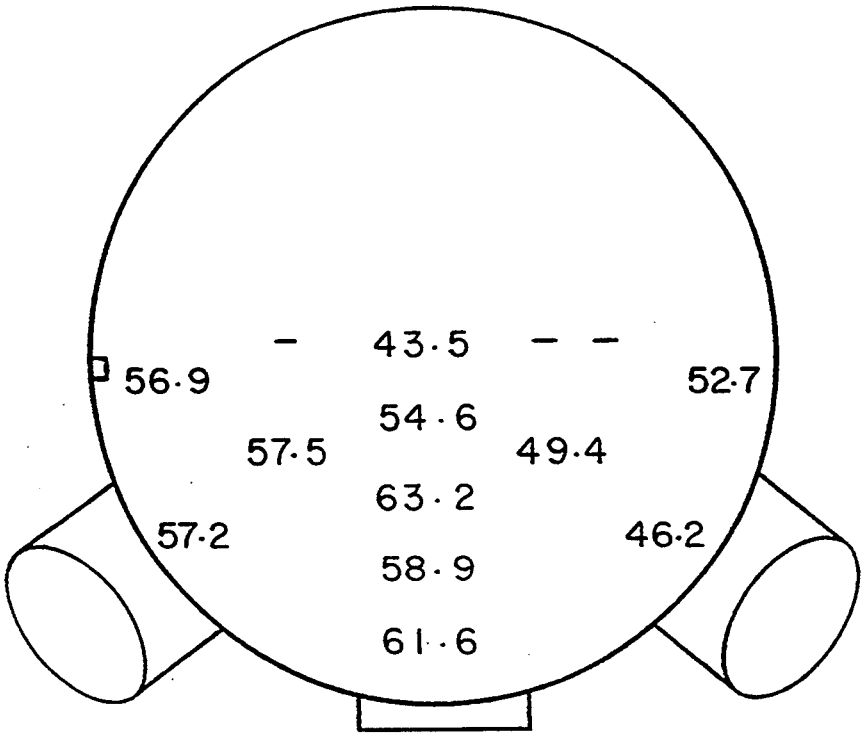
FIGS. 10A and 10B show the GE brightness at the locations shown in FIGS. 8A and 8B for a conventional bed reactor.
Figure 10B:
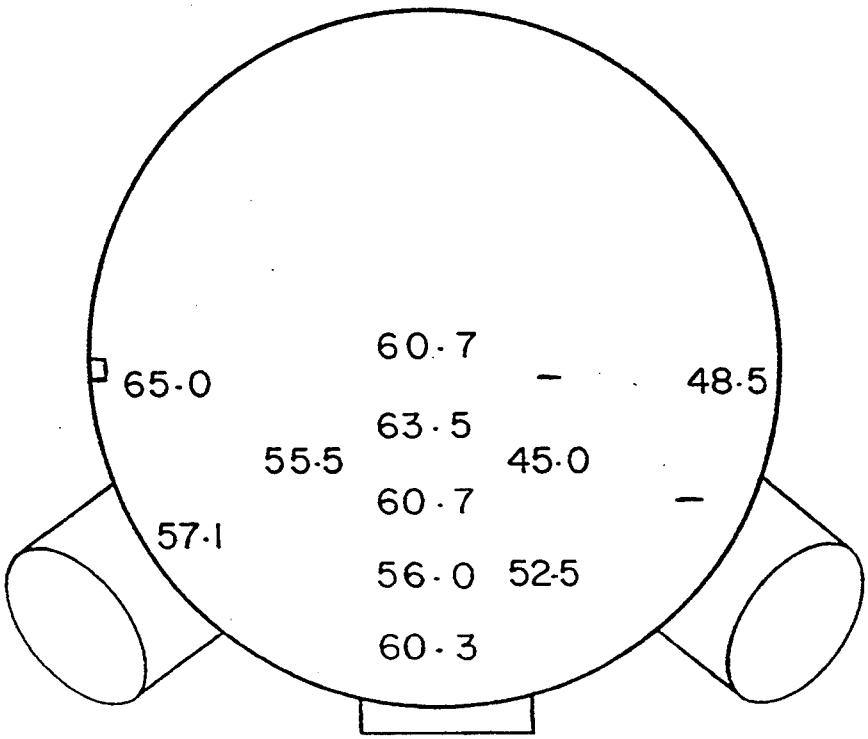

FIGS. 8A and 8B illustrate the twenty-seven bed sampling locations, at levels of about 3 feet and 1½ feet, respectively, above the gas release zone, as shown at A and B in FIG. 2. FIGS. 9A and 9B show the brightness distribution in the second stage of the present invention for the sampling locations illustrated in FIGS. 8A and 8B, respectively. (Samples shown in FIG. 9A were taken along the top of the bed). FIGS. 10A and 10B show the same data for the conventional bed reactor. The data are summarized and compared in Table II, below. Again, comparison of FIGS. 9 and 10, and Table II, show a clear improvement in brightness uniformity for the present invention versus a conventional bed reactor.

TABLE II

| | Two Stage Reactor of Present Invention | Conventional Bed Reactor |
|---|---|---|
| Average Brightness in Bed | 63.4 | 55.7 |
| Standard Deviation of Brightness | 1.3 | 6.0 |
| High Brightness Sample | 65.9 | 65.0 |
| Low Brightness Sample | 61.2 | 43.5 |
| Range of Brightness (High-Low) | 4.7 | 21.5 |

What is claimed is:

1. A reactor apparatus for ozonating high consistency pulp particles, comprising:

first reactor means which comprises high shear mixing and contacting means for contacting high consistency pulp particles and ozone to completely and uniformly mix and contact the pulp particles with the gaseous bleaching mixture by turbulently turning over the pulp particles as said particles are moved through substantially all of the first reactor means so that substantially all of the pulp particles are lifted, tossed and agitated in the presence of the gaseous bleaching agent for reacting at least a portion of the pulp with the ozone in the first reactor means;

second reactor means which comprises retention vessel means for receiving said pulp particles and ozone from said mixing and contacting means and for retaining said pulp particles in a pulp bed wherein pulp particles can further react with unreacted ozone received from said first reactor means for a sufficient time to complete the reaction of the pulp with the ozone; and means connecting the first and second reactor means for directly passing the pulp particles and gaseous bleaching mixture with unreacted ozone from the first reactor means into the second reactor means.

2. The apparatus according to claim 1, wherein the first reactor means further comprises a mixing vessel surrounding the high shear mixing and contacting means and having an inlet for receiving said pulp particles and an outlet for removing the pulp particles and ozone after reaction of at least a portion of the pulp particles with the ozone; and the connecting means includes an inlet on the second reactor means for communicating directly with the outlet of the mixing vessel.

3. The apparatus according to claim 2, wherein the mixing vessel comprises a shell defining the inlet, the outlet and an inner chamber for surrounding the high shear mixing and contacting means, and wherein the high shear mixing and contacting means comprises two parallel rotatable shafts with meshing screw flights mounted thereon for advancing the pulp particles from the inlet to the outlet.

4. The apparatus according to claim 2, wherein the mixing vessel comprises a shell defining the inlet, the outlet and an inner chamber for surrounding the high shear mixing and contacting means, and wherein the high shear mixing and contacting means comprises a rotatable shaft with a plurality of individual radially extending rigid members and a plurality of cooperating rigid members extending inward from said shell toward said shaft.

5. The apparatus according to claim 2, wherein the mixing vessel comprises a shell defining the inlet, the outlet and an inner chamber for surrounding the high shear mixing and contacting means, and wherein the high shear mixing and contacting means comprises a rotatable shaft with a continuous screw flight, wherein said screw flight has a plurality of portions cut from the flight to form openings therein, said cut portions being bent at a predetermined angle with respect to the shaft.

6. The apparatus according to claim 2, further comprising a comminuting unit mounted on said first reactor means for comminuting pulp particles and directing said comminuted pulp particles into said mixing vessel inlet.

7. The apparatus according to claim 6, wherein said first reactor means has a predetermined length between said inlet and outlet and includes means for operating the high shear mixing and contacting means in a manner sufficient to cause between about 50–90% of the ozone in the gaseous bleaching mixture to be consumed by reaction with the pulp particles within said first reactor means.

8. The apparatus according to claim 6, wherein said first reactor means has a predetermined length between said inlet and outlet and includes means for operating the high shear mixing and contacting means in a manner sufficient to retain the pulp particles in contact with the gaseous bleaching mixture for at least about 40 seconds in said first reactor means.

9. The apparatus according to claim 6 wherein the retention vessel means is sized to retain the pulp particles therein for a period of at least about 5 minutes to complete the reaction of the pulp with the ozone.

10. The apparatus of claim 1 further comprising means for providing high consistency pulp particles having a consistency of at least about 20% into the first reactor means.

11. The apparatus of claim 10 further comprising means for providing a gaseous bleaching agent which includes ozone into the first reactor means.

12. The apparatus of according to claim 1 wherein the first reactor means has a length sufficient to retain the pulp particles in contact with the gasseous bleaching mixture until at least about 50% of the ozone has reacted with the particles.

13. The apparatus according to claim 1 wherein the second reactor means is sized to retain the pulp particles therein for a period of at least about 5 minutes to complete the reaction of the pulp with the ozone.

14. An ozone pulp bleaching apparatus for reacting high consistency pulp with a gaseous bleaching mixture containing ozone to bleach said pulp from a first GE brightness to a second, higher GE brightness, said apparatus comprising:

first reactor means for high shear mixing and contacting of high consistency pulp particles having said first GE brightness with a gaseous bleaching mixture containing ozone to mix and contact substantially all of said pulp particles with the gaseous bleaching mixture by turbulently turning over the pulp particles as said particles are moved through substantially all of the first reactor means so that substantially all of the pulp particles are lifted, tossed and agitated in the presence of the gaseous bleaching agent for reacting at least a portion of the pulp particles with said ozone; and second reactor means for receiving said mixed pulp particles and gaseous bleaching mixture from said first reactor means and for retaining said particles in a pulp bed wherein pulp particles can further react with unreacted ozone received from said first reactor means, said second reactor means including means for drawing said gaseous bleaching mixture through the pulp bed to strip substantially all of the ozone from the gaseous bleaching mixture by reaction with the pulp, and means for separating entrained pulp particles from the stripped gaseous bleaching mixture; and means connecting the first and second reactor means for directly passing the pulp particles and gaseous bleaching mixture with unreacted ozone from the first reactor means into the second reactor means.

15. The apparatus according to claim 14, wherein said first reactor means includes a shell defining an inlet and an outlet; and means for conveying said pulp particles from the inlet to the outlet simultaneously with said high shear mixing and contacting of said pulp particles with the gaseous bleaching mixture.

16. The apparatus according to claim 15, wherein said first reactor means has a predetermined length between said inlet and outlet and said conveying means includes means for rotating the conveying means at a speed sufficient to cause between about 50–90% of the ozone in the gaseous bleaching mixture to be consumed by reaction with the pulp particles within said first reactor means.

17. The apparatus according to claim 16, wherein said second reactor means comprises a vertical generally cylindrical vessel having a top and a bottom, with said top being joined to the shell of said first reactor means by the connecting means to communicate with said first reactor means for receiving said pulp particles and gaseous bleaching mixture.

18. The apparatus according to claim 17, wherein said first reactor means is any one of a steam mixer, an extruder, a screw defibrator or a cut-and-folded screw flight conveyor.

19. The apparatus according to claim 17, wherein said shell of the first reactor means further defines at least one inner chamber communicating with the inlet and outlet, and said conveying means comprises:

at least one rotatable central shaft extending the length of said inner chamber; and extending means mounted on said shaft for lifting, tossing and agitating the pulp particles while moving them from the inlet to the outlet.

20. The apparatus according to claim 19, wherein said extending means comprises a continuous flight screw surrounding said shaft and having a plurality of portions which are cut from the flight to form openings therein, said cut portions being bent at a predetermined angle with respect to the shaft.

21. The apparatus according to claim 15, wherein said first reactor means has a predetermined length between said inlet and outlet and said conveying means includes means for rotating the conveying means at a speed sufficient to retain the pulp particles in contact with the gaseous bleaching mixture for at least about 40 seconds in said first reactor means.

22. The apparatus according to claim 15, wherein the second reactor means is sized to retain the pulp particles therein for a period of at least about 5 minutes to complete the reaction of the pulp with the ozone.

23. An ozone pulp bleaching system, comprising in combination:

means for mixing a low consistency pulp with acidifying and chelating agents;

thickening means for dewatering said low consistency pulp to provide a high consistency pulp of greater than 20% consistency;

pump means for transporting the low consistency pulp to the thickening means;

fluffer means for comminuting said high consistency pulp to a desired particle size and bulk density;

tapered conveyor means for compacting said high consistency pulp and transporting it in a plug-like manner to said fluffer means;

means for introducing an ozone containing gaseous bleaching mixture into said fluffer means, cocurrently with said pulp; and a two stage ozone-pulp reactor communicating with said fluffer means to receive said high consistency pulp and ozone containing gas, said reactor comprising first reactor means for high shear mixing and contacting of said high consistency pulp particles with the ozone containing bleaching mixture to mix and contact substantially all of said pulp particles with ozone and for reacting at least a portion of the pulp particles with ozone, said first reactor means including a shell defining an inlet and an outlet, and means for conveying said pulp particles from the inlet to the outlet while said pulp particles are mixed and contacted with the ozone containing bleaching mixture, said conveying means including at least one rotatable shaft extending the length of said shell, and extending means mounted on said shaft for lifting, tossing and agitating the pulp particles while moving them from the inlet to the outlet; said first reactor means further having a predetermined length between said inlet and outlet and said conveying means including means for rotating the shaft at a speed sufficient to cause between about 50–90% of the ozone in the gaseous bleaching mixture to be consumed by reaction with the pulp particles within said shell, and second reactor means for receiving said mixed pulp particles and gaseous bleaching mixture from the first reactor means and for retaining said pulp particles in a pulp bed wherein the pulp particles can react with uncontacted and unreacted ozone in said gaseous bleaching mixture, said second reactor means comprising a generally cylindrical shell having a top and a bottom, said top disposed adjacent to the shell of the first reactor means and defining an inlet communicating directly with the outlet of said first reactor means for receiving the mixed pulp and gaseous bleaching mixture, said second reactor means including means for drawing said gaseous bleaching mixture through the pulp bed to strip substantially all residual ozone from said mixture, and means for separating entrained pulp particles from the ozone stripped bleaching mixture.

24. The apparatus according to claim 23, wherein said extending means comprises a continuous flight screw surrounding said shaft and having a plurality of portions which are cut from the flight to form openings therein, said cut portion being bent at a predetermined angle with respect to the shaft.

25. The apparatus according to claim 23, wherein said first reactor means is any one of a steam mixer, an extruder, a screw defibrator or a cut-and-folded screw flight conveyor.

26. The system according to claim 23, wherein said first reactor means includes means for rotating the conveying means at a speed sufficient to retain the pulp particles in contact with the gaseous bleaching mixture for at least about 40 seconds in said first reactor means.

27. The system according to claim 23, wherein the second reactor means is sized to retain the pulp particles therein for a period of at least about 5 minutes to complete the reaction of the pulp with the ozone.

* * * * *